US007023961B2

(12) United States Patent
Hatanaka et al.

(10) Patent No.: US 7,023,961 B2
(45) Date of Patent: Apr. 4, 2006

(54) METHOD AND APPARATUS FOR GENERATING X-RAY

(75) Inventors: Koji Hatanaka, Miyagi (JP); Hiroshi Fukumura, Miyagi (JP)

(73) Assignee: Japan Science and Technology Agency, Kawaguchi (JP)

( * ) Notice: Subject to any disclaimer, the term of this patent is extended or adjusted under 35 U.S.C. 154(b) by 0 days.

(21) Appl. No.: 10/480,258

(22) PCT Filed: Mar. 14, 2002

(86) PCT No.: PCT/JP02/02413

§ 371 (c)(1),
(2), (4) Date: Dec. 18, 2003

(87) PCT Pub. No.: WO03/013197

PCT Pub. Date: Feb. 13, 2003

(65) Prior Publication Data

US 2004/0156475 A1 Aug. 12, 2004

(30) Foreign Application Priority Data

Jul. 31, 2001 (JP) ..... 2001-232038

(51) Int. Cl.
*H01J 35/00* (2006.01)

(52) U.S. Cl. ..... 378/119; 378/143

(58) Field of Classification Search ..... 378/34, 378/119, 143
See application file for complete search history.

(56) References Cited

U.S. PATENT DOCUMENTS 5,459,771 A * 10/1995 Richardson et al. ..... 378/119
6,307,913 B1 * 10/2001 Foster et al. ..... 378/34
6,831,963 B1 * 12/2004 Richardson ..... 378/119

FOREIGN PATENT DOCUMENTS

JP 2-267895 11/1990
JP 4-110800 4/1992

* cited by examiner

*Primary Examiner*—Edward J. Glick
*Assistant Examiner*—Courtney Thomas
(74) *Attorney, Agent, or Firm*—Oblon, Spivak, McClelland, Maier & Neustadt, P.C.

(57) ABSTRACT

A method and an apparatus for generating X-rays in which continuous X-rays can be generated by irradiating a focused laser in the air using a liquid as a target, thereby generating plasma. A high concentration electrolyte aqueous solution, such as CsCl and RbCl, is circulated by means of a pump (2) and the surface of a jet of high concentration electrolyte aqueous solution injected from a glass nozzle (3) is exposed to an irradiation of focused femtosecond laser pulse (6) via an objective lens (7), thereby generating X-ray pulses.

4 Claims, 5 Drawing Sheets

METHOD AND APPARATUS FOR GENERATING X-RAY

TECHNICAL FIELD

The present invention relates to a method and an apparatus for generating X-rays and, more specifically, to a method and an apparatus for generating X-rays from plasma generated by irradiating a laser using a liquid as a target.

BACKGROUND ART

In general, it is essential to generalize and downsize a light source when considering development of an X-ray pulse in the field of physical chemistry. However, targets used in approaches for generating X-ray pulses in the related art have been limited to metal foils or rare gas jets in a vacuum chamber. The present inventors have been conducting experiments for development and utilization of lasers instead of these targets for generating the X-ray pulses, which can be used under the atmospheric pressure.

We have already found that the fluorescence behavior of solid state organic molecules when using picosecond X-ray pulses generated from a photo-excitable X-ray tube and a laser as an excitation light has a characteristic element dependency in excitation of X-rays (Hatanaka et al, Summary of Lecture in Panel Discussion on Photochemistry, 2000, 2A29 (Sapporo, 2000)).

DISCLOSURE OF INVENTION

Since an apparatus for generating X-rays in the related art is associated with a vacuum system, or is used in a state of having vacuum encapsulated as described above, vacuum environment has been indispensable.

In the X-ray generation from laser-induced plasma using a solid state as a target in the related art, the X-ray generation cannot be continued in a stable state for a long time because of an ablation phenomenon. In addition, the targets cannot be recycled.

In view of such circumstances, it is an object of the present invention to provide a method and an apparatus for generating X-rays in which focused X-rays can be generated by irradiating a focused laser in the air using a liquid as a target, thereby generating plasma.

In order to achieve the object described above, the present invention is:

(1) A method of generating X-rays including the steps of generating a flow of an electrolyte aqueous solution in the air, and irradiating a focused laser to the flow of the electrolyte aqueous solution to allow plasma to be generated in the electrolyte aqueous solution thereby generating continuous X-rays as bremsstrahlung due to loss of energy occurred mainly when the electron orbit is bent by ions.

(2) The method of generating X-rays according to (1), characterized in that the X-ray emission intensity is changed by changing the laser intensity.

(3) The method of generating X-rays according to (1), characterized in that the shape of X-ray spectrum is changed by changing the kind of species of the electrolyte.

(4) The method of generating X-rays according to (1), characterized in that the X-ray emission intensity and the shape of X-ray spectrum are changed by changing the concentration of the electrolyte aqueous solution.

(5) An apparatus for generating X-rays including a unit for supplying a flow of an electrolyte aqueous solution in the air, and a unit for irradiating a focused laser onto the flow of the electrolyte aqueous solution to allow plasma to be generated in the electrolyte aqueous solution thereby generating continuous X-rays as bremsstrahlung due to loss of energy occurred mainly when the electron orbit is bent by ions.

(6) The apparatus for generating X-rays according to (5), characterized in that the electrolyte aqueous solution includes CsCl and RbCl.

BEST MODE FOR CARRYING OUT THE INVENTION

An embodiment of the present invention will be described in detail below.

Figure 1:
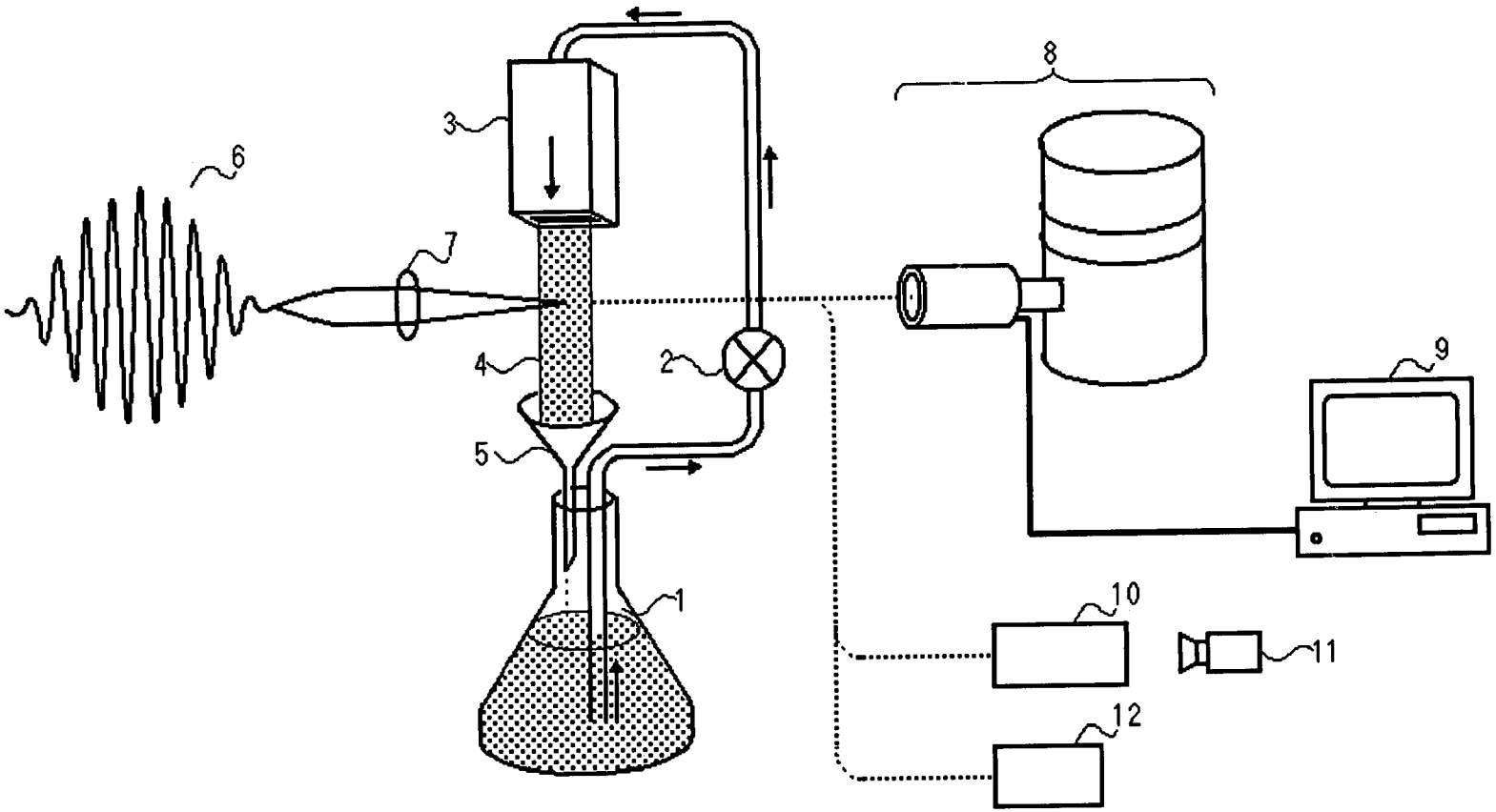
FIG. 1 is a schematic drawing of an apparatus for generating X-rays according to an embodiment of the present invention.

FIG. 1 is a schematic drawing of an apparatus for generating X-rays according to the embodiment of the present invention.

In this drawing, reference numeral 1 designates a container for storing an electrolyte aqueous solution, reference numeral 2 designates a pump for pumping the electrolyte aqueous solution, reference numeral 3 designates a glass nozzle, reference numeral 4 designates a solution jet film, reference numeral 5 designates a funnel for collecting the electrolyte aqueous solution, reference numeral 6 designates femtosecond laser pulses (Clark MXR., CPA-2001), 130 fs, 775 nm, 1 kHz, <1 mJ/pulse, reference numeral 7 designates an objective lens (Mitutoyo M Plan Apo 10), NA=0.28, reference numeral 8 designates a Ge energy analyzer (EG&G Ortec, GLP-25440-S, sensitivity range: 3 keV or larger), reference numeral 9 designates a computer, reference numeral 10 designates a X-ray image intensifier (Hamamatsu Photonics KK, V7739P), reference numeral 11 designates a CCD camera (Sony, XC-7500), reference numeral 12 designates a streak camera (Hamamatsu Photonics KK, C2830).

Using the apparatus for generating X-rays arranged as described above, the high concentration electrolyte aqueous solution, such as CsCl and RbCl, was circulated by means of a pump 2 and the surface of a jet of the high concentration electrolyte aqueous solution injected from the glass nozzle 3 was exposed to an irradiation of focused femtosecond laser pulses 6 via the objective lens 7, thereby generating X-ray pulses.

When energy spectrum of the generated X-ray pulses was measured by the Ge energy analyzer 8, it was already found that X-rays at approximately 40 keV or lower were generated.

On the other hand, X-ray pulses were generated by exposing the surface of the aforementioned electrolyte aqueous solution to an irradiation of focused femtosecond laser pulses 6 via the objective lens 7, and then a photograph of an image of plasma was taken by the X-ray image intensifier 10, and then picosecond time-resolved emission spectral measurement was conducted in the visible ultraviolet range by the streak camera 12.

This embodiment enables generation of X-rays in the air, and a target surface which is always clean can be provided by circulating the solution using the pump. In addition, the solution to be used can be recycled repeatedly. Therefore, generation of X-rays in a stable state for a long time was achieved.

Figure 2:
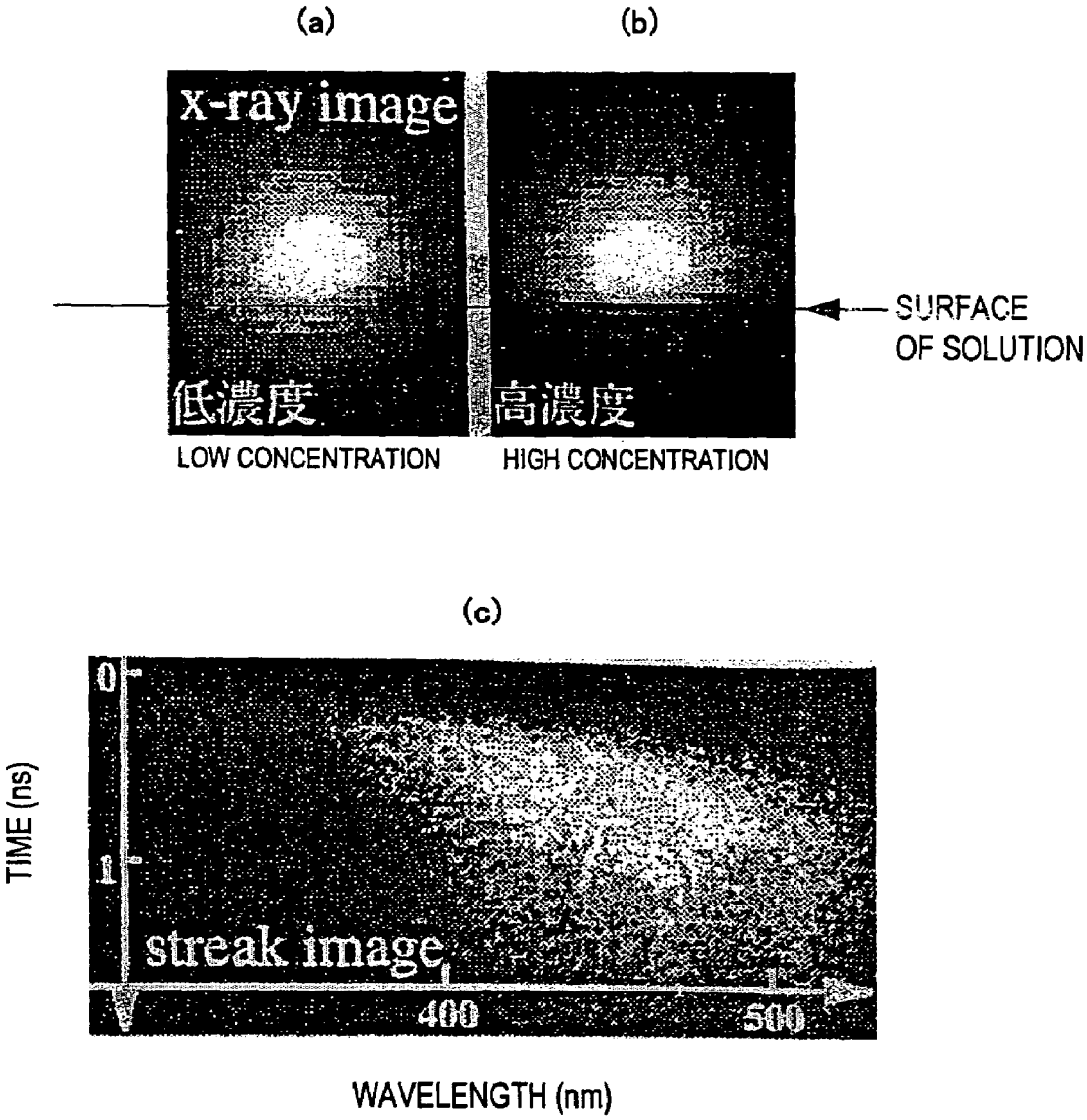
FIG. 2 shows a light source image and a streak image of plasma generated on the surface of an electrolyte aqueous solution showing the result of the embodiment of the present invention.

FIG. 2 is a light source image and a streak image of plasma generated on the surface of the electrolyte aqueous solution showing the result of the embodiment of the present invention.

FIG. 2(*a*) shows a case in which a solution such as iron chloride of low concentration is used, FIG. 2(*b*) shows a case in which a solution such as iron chloride of high concentration is used, and FIG. 2(*c*) is a characteristic drawing showing wavelengths vs. elapsed time.

As is clear from FIG. 2(*a*) and FIG. 2(*b*), the intensity of the X-ray energy from the inside of the liquid surface is lowered with increase in concentration of the electrolyte aqueous solution (such as iron chloride). It is thought to be aftereffects of reabsorption, for example, by metal ion. Referring to luminescence behavior shown in FIG. 2(*c*), it is observed that the peak wavelength of luminescence is shifted toward the side of the longer wavelength with time. It is thought to be a luminescence based on the bremsstrahlung, and implies that the X-rays were generated in the earlier time zone and, subsequently, the temperature of plasma was decreasing with time.

Figure 3:
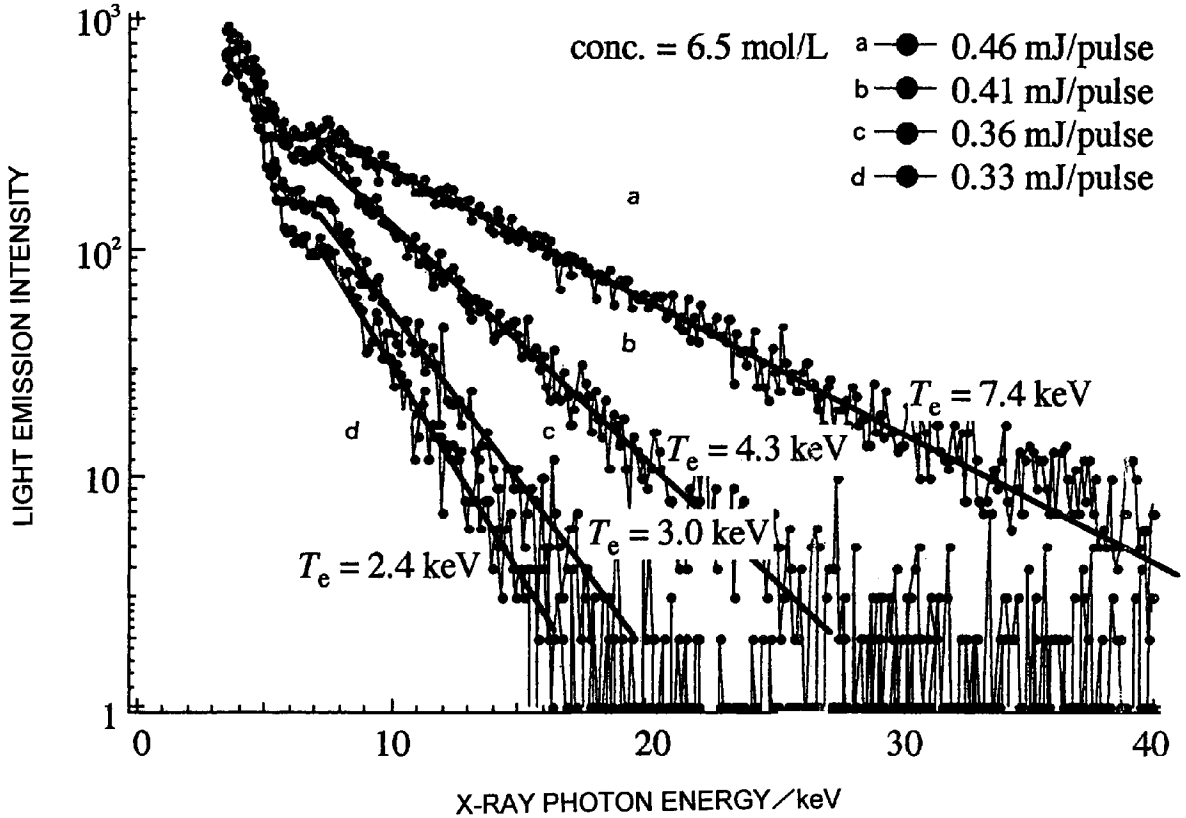
FIG. 3 is a drawing showing an X-ray emission spectrum depending on the laser intensity according to the present invention.

FIG. 3 is a drawing showing an X-ray emission spectrum depending on the laser intensity according to the present invention.

This drawing shows the values of X-ray emission at the laser intensity of a: 0.46 mJ/pulse, b: 0.41 mJ/pulse, c: 0.36 mJ/pulse, and d: 0.33 mJ/pulse for a solution of 6.5 mol/L (here, L represents litters). In case of a, the electron temperature Te=7.4 keV, in case of b, the electron temperature Te=4.3 keV, in case of c, the electron temperature Te=3.0 keV, and in case of d, the electron temperature Te=2.4 keV. When the electron temperature Te is high, the average of electron kinetic energy is correspondingly high.

As is clear from this drawing, it is understood that the intensity of X-ray energy can be changed by changing the intensity of the laser.

Figure 4:
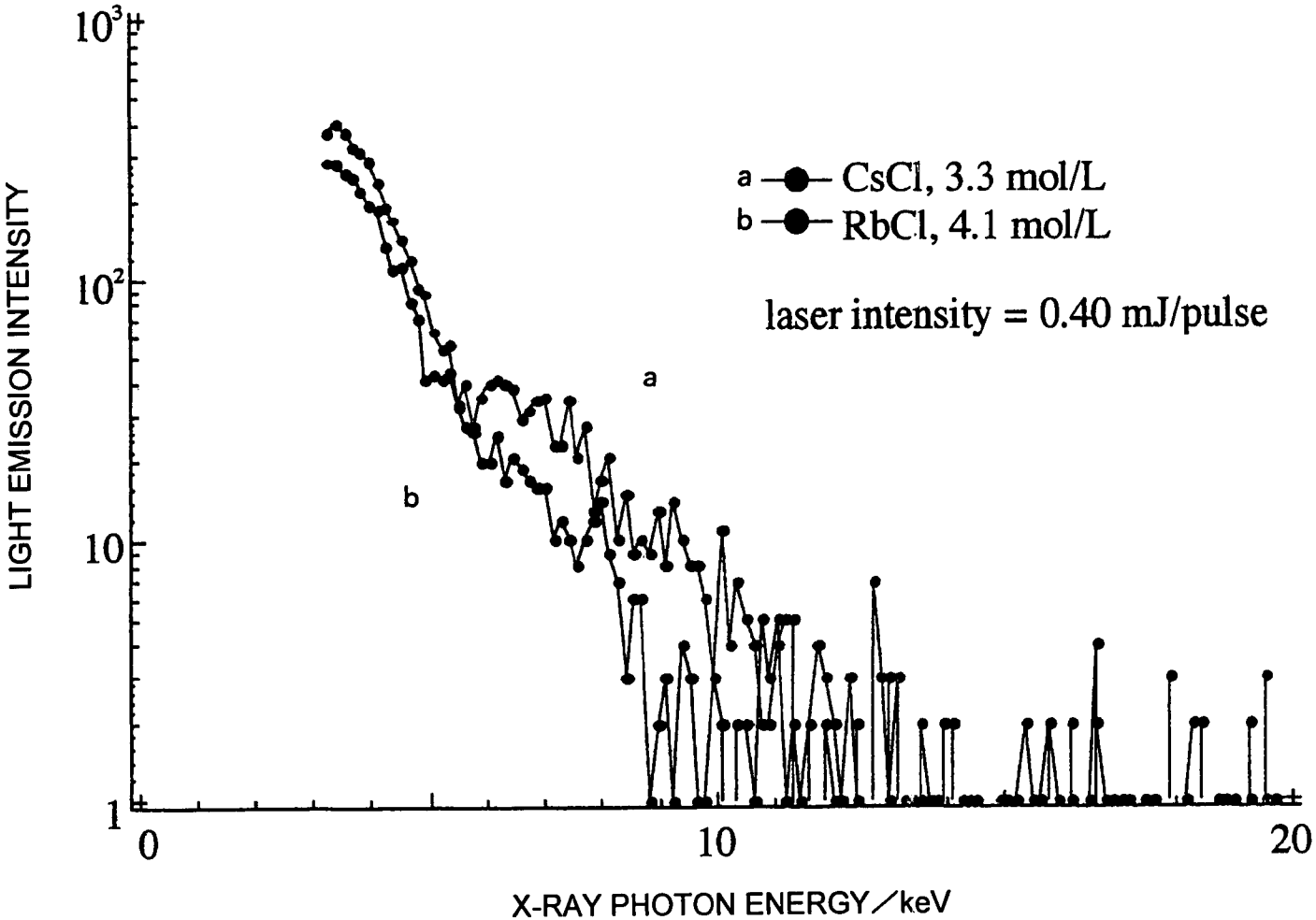
FIG. 4 is a drawing showing an X-ray emission spectrum depending on the Z-number of cations according to the present invention.

FIG. 4 is a drawing showing an X-ray emission spectrum depending on the Z-number of cations according to the present invention.

In this drawing, "a" represents an X-ray intensity of CsCl of 3.3 mol/L, and "b" represents an X-ray intensity of RbCl of 4.1 mol/L.

As is clear from this drawing, the intensity of X-ray energy can be changed by changing the kind of species of electrolyte.

Figure 5:
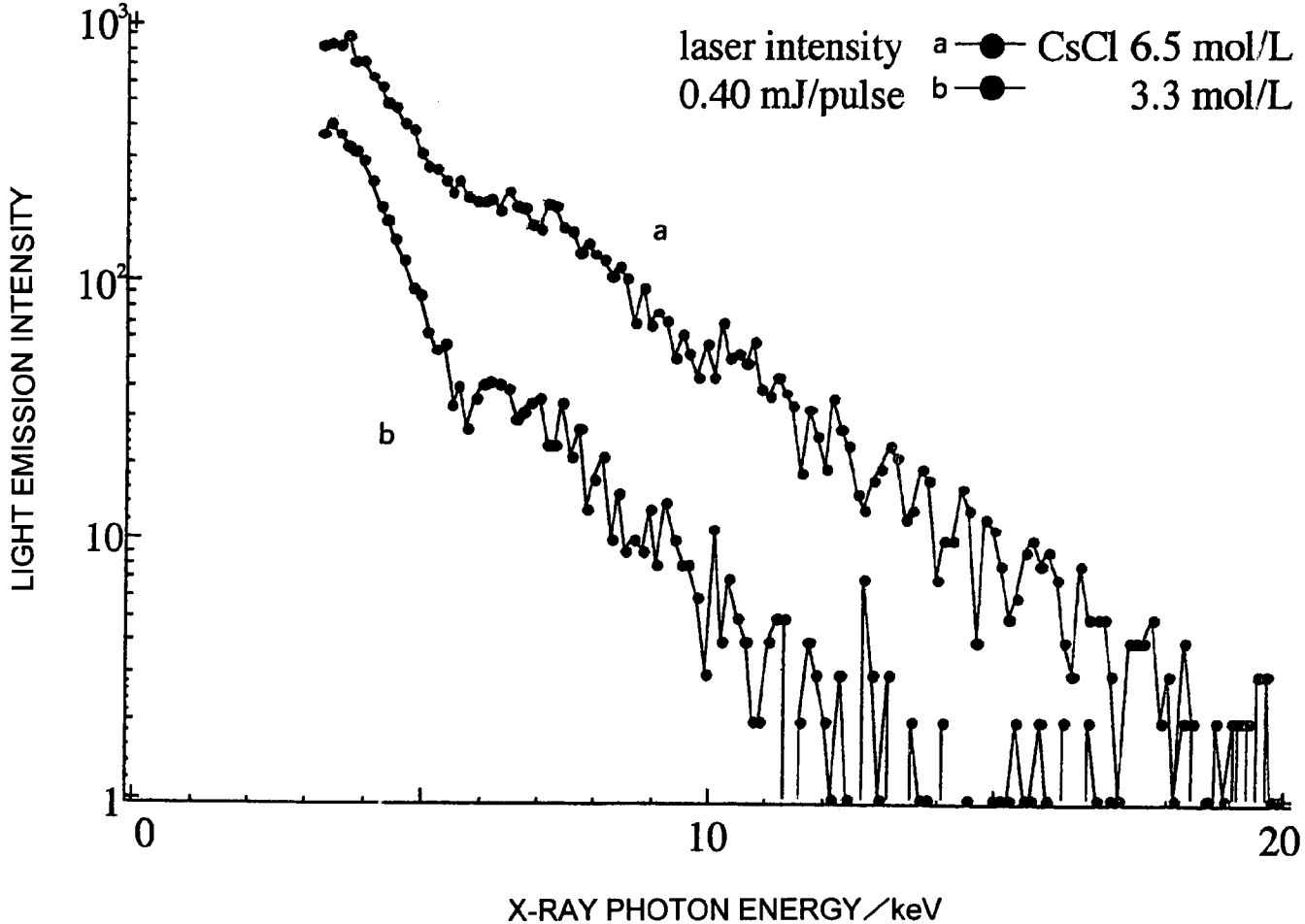
FIG. 5 is a drawing showing an X-ray emission spectrum depending on the concentration of the solution according to the present invention.

FIG. 5 is a drawing showing an X-ray emission spectrum depending on the concentration of the solution according to the present invention.

This drawing shows the intensity of X-ray vs. the concentration of CsCl, that is, "a" represents the intensity of X-ray vs. the concentration of CsCl of 6.5 mol/L, and "b" represents the intensity of X-ray vs. CsCl of 3.3 mol/L.

As is clear from this drawing, the X-ray emission intensity is high when the concentration of the CsCl solution is high, and the X-ray emission intensity is low when the concentration of the CsCl solution is low. In other words, it is understood that the intensity of X-ray energy can be changed by changing the concentration of the solution.

The present invention is not limited to the embodiment described above, and may be modified within the scope of the present invention, and thus such modification is not excluded from the scope of the invention.

As described in detail thus far, according to the present invention, the following effects are achieved.

(A) Since generation of X-ray in the air is enabled, and thus X-ray pulses in a stable state can be supplied for a long time, it is thought to be effective when used as a light source for measurement which takes time, such as time-resolved X-ray diffraction method, and may play a significant role in the field of material development or biological science.

(B) A white X-ray of about 3–40 keV can be obtained. While the characteristic X-ray peak is mixed in the method of generating X-ray in the related art, a continuous white X-ray can be obtained in the energy region in which the characteristic X-ray peak is not mixed.

(C) A point source may be obtained.

(D) Deterioration of targets can be ignored.

(E) Stability of the intensity of generated X-ray can be maintained at high level for a long time.

INDUSTRIAL APPLICABILITY

A method and an apparatus for generating X-ray according to the present invention do not require a vacuum chamber, which contributes to energy saving and downsizing, and thus is suitable as a light source for an analyzing apparatus or a diagnostic system in material or biological science.

The invention claimed is:

1. A method of generating X-rays comprising the steps of:
   generating a continuously downward flow of an electrolyte aqueous solution in air;
   irradiating the flow of the electrolyte aqueous solution with a focused femtosecond laser pulse via an objective lens so as to generate a plasma, thus generating continuous white X-rays of about 3–40 keV as bremsstrahlung due to loss of energy occurring mainly when an electron orbit is bent by ions; and
   circulating upward electrolyte aqueous solution accumulated on a downside from a point of plasma generation by means of a pump.

2. A method of generating X-rays according to claim 1, wherein an X-ray emission intensity and a shape of an X-ray spectrum are changed by changing the concentration of the electrolyte aqueous solution.

3. An apparatus for generating X-rays, comprising:
   (a) a unit configured to supply a flow of an electrolyte aqueous solution in air;
   (b) a pump configured to circulate the electrolyte aqueous solution;
   (c) a unit configured to irradiate a focused femtosecond laser via an objective lens onto the flow of the electrolyte aqueous solution in the air; and
   (d) a unit configured to allow plasma to be generated in the electrolyte aqueous solution thereby generating continuous white X-rays of about 3–40 keV as bremsstrahlung due to loss of energy occurring mainly when an electron orbit is bent by ions.

4. An apparatus for generating X-rays according to claim 3, wherein the electrolyte aqueous solution comprises CsCl or RbCl.

* * * * *